United States Patent [19]

Kramer

[11] 4,244,503

[45] Jan. 13, 1981

[54] DISPENSER FOR FLEXIBLE MATERIAL

[76] Inventor: Steven G. Kramer, 60 El Verano Way, San Francisco, Calif. 94127

[21] Appl. No.: 56,056

[22] Filed: Jul. 9, 1979

[51] Int. Cl.[3] ..... B26F 3/02

[52] U.S. Cl. ..... 225/46; 225/12; 225/82; 225/106

[58] Field of Search ..... 225/12, 82, 10, 46, 225/106; 242/55.2, 55.53; 312/41

[56] References Cited

U.S. PATENT DOCUMENTS

| | | | |
|---|---|---|---|
| 688,459 | 12/1901 | Fender | 225/106 |
| 2,166,320 | 7/1939 | Posatsky | 225/82 X |
| 2,305,592 | 12/1942 | Anderson | 225/12 |

FOREIGN PATENT DOCUMENTS

| | | | |
|---|---|---|---|
| 2201544 | 5/1973 | Fed. Rep. of Germany | 225/10 |

*Primary Examiner*—Frank T. Yost

*Attorney, Agent, or Firm*—Emrich, Root, Lee, Brown & Hill

[57] ABSTRACT

A dispenser for flexible material, wherein the material is disposed in a roll in a housing having a dispensing opening therein, and the material is dispensed by pulling thereon to thereby rotate the roll in the housing, detents being afforded on the roll and housing that are effective to periodically releasably resist further dispensing rotation of the roll during each rotation of the roll.

12 Claims, 8 Drawing Figures

DISPENSER FOR FLEXIBLE MATERIAL

BACKGROUND OF THE INVENTION

This invention relates to dispensers for flexible material, and, more particularly, to dispensers which are particularly well adapted for dispensing pressure sensitive tape, and the like, from rolls.

A primary object of the present invention is to afford a novel dispenser.

Another object of the present invention is to afford a novel dispenser for dispensing flexible material from a roll of the material.

A further object of the present invention is to afford a novel dispenser for flexible material, wherein the flexible material is disposed in the dispenser in a roll, and the material is dispensed by pulling outwardly thereon and thereby unwinding the material from the roll.

Another object of the present invention is to afford a novel dispenser of the aforementioned roll type, wherein the parts thereof are constituted and arranged in a novel and expeditious manner to afford effective assistance in regulating the length of material being dispensed in any dispensing operation.

Dispensers for dispensing pressure sensitive tape and other flexible material from rolls, and which have embodied mechanism for measuring or assisting in determining various lengths of material being dispensed have been heretofore known in the art, being shown for example in U.S. Pat. Nos. 2,547,583, issued to A. P. Krueger; 2,617,198, issued to E. E. Sharpe; 2,671,271, issued to J. W. Aldridge; and 3,396,471, issued to G. P. Taylor. It is an important object of the present invention to afford improvements over such dispensers heretofore known in the art.

Another object of the present invention is to afford a novel dispenser of the aforementioned roll type wherein, when material is pulled from the roll, noticeable, but yieldable or releasable resistance to further rotation of the roll is encountered at predetermined points in each rotation of the roll to assist in measuring the desired amount of material being dispensed.

Another object of the present invention is to afford a novel dispenser of the aforementioned roll type for pressure sensitive tape, which dispenser embodies a cutter bar across which the tape to be removed is severed, and on which cutter bar the leading edge of the remaining tape adheres.

An object ancillary to the foregoing is to afford a novel dispenser of the aforementioned type, wherein, at intervals in the rotation of the roll, resistance to rotation thereof is encountered so that, when the tape is severed across the cutter bar at such time, the force applying the tape to the cutter bar for adherence thereto is increased.

Another object of the present invention is to afford a novel dispenser of the aforementioned roll type, wherein, at intervals during each full rotation of the roll, in a dispensing operation, a sound, which is audible to the human ear, is emitted to aid the person dispensing the tape to determine the amount of tape being dispensed.

Another object of the present invention is to afford a novel dispenser of the aforementioned roll type, which is practical and efficient in operation and which may be readily and economically produced commercially.

Other and further objects of the present invention will be apparent from the following description and claims and are illustrated in the accompanying drawings, which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENTS SHOWN HEREIN

Figure 1:
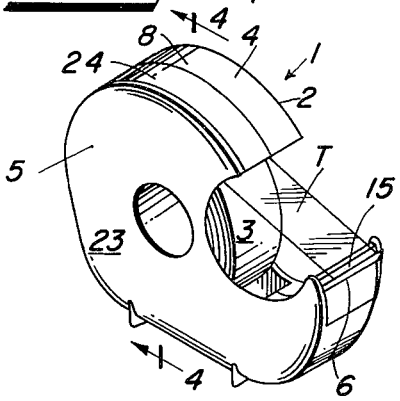
FIG. 1 is a perspective view of a dispenser embodying the principles of the present invention.

A dispenser 1, embodying a housing 2, having a roll 3 of pressure sensitive tape T mounted in operative position therein for dispensing of the tape T from the roll 3 outwardly from the housing 2, is shown in FIGS. 1–4 of the drawings to illustrate the presently preferred embodiment of the present invention.

The housing 2 of the dispenser 1 is of a type well known in the art, having been marketed for several years by the 3M Company, St. Paul, Minnesota. It embodies a body portion 4, FIGS. 1 and 2, and a cover portion 5, FIGS. 1 and 3, which are separable from each other along a central plane 6, FIG. 1, The body portion 4 is substantially cup-shaped and has a substantially flat sidewall 7, from the outer peripheral edge of which a rim 8 projects inwardly toward the cover 5. The rim 8 extends around the major portion of the periphery of the sidewall 7, and terminates at the front end portion of the housing 2 in an edge 9. The rim 8 terminates at its other end in an edge 10, which is rearwardly spaced from the edge 9, to define a dispensing opening 11 between the edges 9 and 10, FIG. 2. A partition wall 12 projects inwardly from the sidewall 7 in rearwardly spaced relation to the front portion of the rim 8, and terminates at its upper end in an edge 13, which is disposed in rearwardly spaced relation to the edge 9 of the rim 8 in position to define an opening 14 therebetween.

Figure 2:
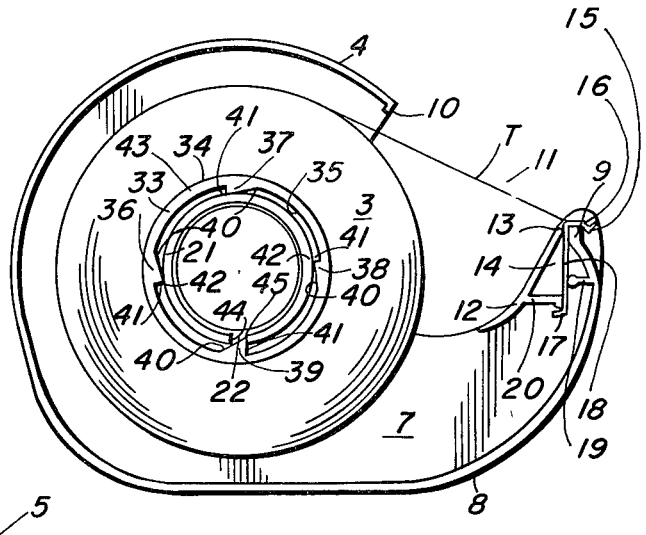
FIG. 2 is an elevational view of the interior of the body of the dispenser, with the cover removed.
Figure 3:
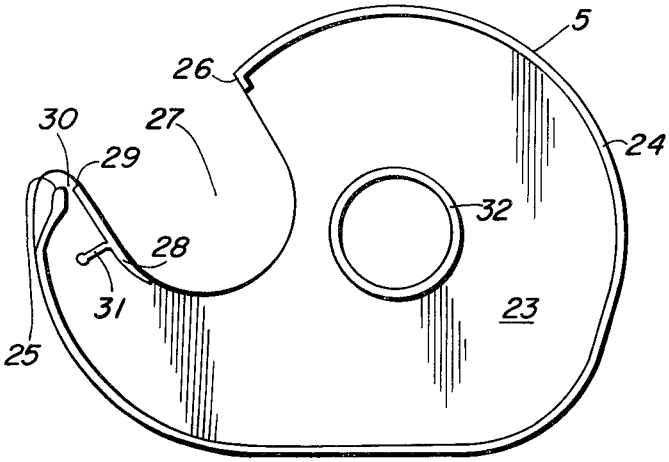
FIG. 3 is an elevational view of the interior of the cover of the dispenser, removed from the body thereof.

A cutter bar 15, having a head portion 16 and a flange portion 17 disposed in oppositely projecting relation to each other at respective opposite ends of an elongated body portion 18 is disposed in the body portion 4 of the housing 2, with the head portion 16 resting on the edge 9 of the flange 8, and the body portion 18 projecting downwardly through the opening 14 between the edge portions 9 and 13, FIG. 2.

An abutment member 19 projects inwardly from the rim 8 toward the partition wall 12 in downwardly spaced relation to the edge 9 of the flange 8, and a similar abutment member 20 projects outwardly from the partition wall 12 toward the rim 8, the abutment member 20 being disposed below the abutment member 19, as viewed in FIG. 2. The abutment members 19 and 20 are so disposed relative to each other, that when the cutter bar 15 is disposed in operative position in the body portion 4, they abuttingly engage opposite sides of the body portion 18 of the cutter bar 15 with a relatively snug, frictional fit, effective to hold the cutter bar 15 in assembled relation in the body portion 4. The flange 17 of the cutter bar 15 is disposed in underlying juxtaposition to the abutment member 20, and the head portion 16 is disposed in overlying juxtaposition to the edge 9 of the flange 8 to further secure the cutter bar 15 in assembled position in the body portion 4.

The body portion 4 also embodies a substantially cylindrical shaped hub 21, projecting inwardly from the sidewall 7 in rearwardly spaced relation to the opening 11 and in substantially centrally disposed position between the upper and lower extremities of the rim 8. The hub 21 has a slot 22 therethrough, the slot 22 extending longitudinally of the hub 21 throughout the length thereof. The body portion 4, within which the cutter bar 15 is removably mounted, may be made of one piece, and may be made of any suitable material, such as, for example, high impact polystyrene.

The cover portion 5 of the housing 2 is similar in shape and construction to the body portion 4 thereof, and, in fact, is substantially a mirror image thereof except for certain variations. Thus, it will be seen, FIG. 3, that the cover member 5 embodies a sidewall 23 from the outer peripheral edge of which a rim 24 projects, with the rim 24 terminating at a front edge 25 and a rear edge 26 to define an opening 27 therebetween. Also, a partition wall 28 projects inwardly from the sidewall 23 in rearwardly spaced relation to the front edge portion of the rim 24 and terminates at its upper end in an edge 29, which is spaced from the edge 25 to define an opening 30 therebetween. An abutment member 31, corresponding to the abutment member 20 of the body portion 4, projects outwardly from the partition wall 28 toward the front end portion of the rim 24. Also, like the body portion 4, the cover member 5 has a substantially cylindrical shaped hub 32 projecting inwardly from the sidewall 23 in rearwardly spaced relation to the opening 27, and in substantially centrally disposed position between the upper and lower extremities of the rim 24. The outer diameter of the hub 32 is such that, in the assembled housing 2, it fits in the hub 21 of the body portion 4 with a relatively snug, but removable, frictional fit.

Like the body portion 4, the cover member 5 preferably is of one-piece construction, and may be made of any suitable material, such as, for example, the aforementioned high impact polystyrene. It is of such size and configuration that when the parts of the housing 2 are disposed in assembled relation to each other, the cover member 5 is mounted on the body portion 4 with the rim 24 disposed in abutting engagement with the rim 8, and with the partition wall 28 and abutment member 31 disposed in abutting engagement with the partition wall 12 and the abutment member 20, respectively, of the body portion 4. The cutter bar 15 is of such length inwardly from the sidewall 7, that it projects into the cover 5, and when the cover 5 is disposed in assembled position on the body portion 4, the front edge of the abutment member 31 is disposed in abutting engagement with the body portion 18 of the cutter bar 15. In this assembled position of the body portion 4 and the cover 5, the hub 32 of the cover 5 is disposed in the hub 21 of the body portion 4 with the aforementioned frictional fit.

The housing 2, with the cutter bar 15 disposed therein, as hereinbefore described, is well known in the art, constituting the housing of the aforementioned dispenser, which has been marketed for several years by the 3M Company, St. Paul, Minnesota.

In the dispenser 1, shown in FIGS. 1–4 of the drawings, the roll 3 of tape is mounted on a spool 33, which is substantially cylindrical in shape, having an outer periphery 34 on which the roll 3 is disposed in snug frictional engagement therewith, and having an inner peripheral surface 35 from which four detents, in the form of teeth 36, 37, 38 and 39, project inwardly therefrom in equally spaced relation to each other thereround, FIG. 2.

Figure 4:
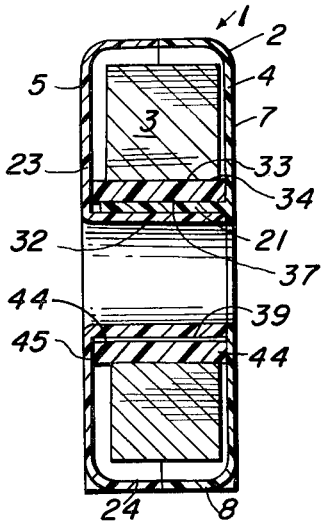
FIG. 4 is a sectional view taken substantially along the line 4–4 in FIG. 1.

In the assembled dispenser 1, the spool 33 is mounted on the hub 21 for rotation in a clockwise direction, as viewed in FIG. 2, during rotation of the roll 3 in a direction for unwinding the tape T therefrom. Each of the detents or teeth 36–39 has a leading edge 40 and a trailing edge 41 projecting inwardly toward each other from the inner periphery 35 of the spool 33, to form an inner edge or point 42. Preferably, the trailing edges 41 are disposed on respective radii of the hub 33 and the leading edges 40 are disposed at an acute angle to the trailing edges 41 on the respective teeth 36–39. The main body portion 43 of the spool 33 preferably is of such width that when the dispenser 1 is in assembled form, the outer sides 44 and 45 of the main body portion 43, FIG. 4, are disposed in slidable, frictional engagement with the inner faces of the sidewalls 7 and 23 of the body portion 4 and cover 5 of the housing 2, respectively. Each of the teeth 36–39 is elongated in a direction parallel to the longitudinal axis of the spool 33 and terminates at its opposite ends in inwardly spaced relation to the sides 44 and 45, respectively, of the body portion 43 and the spool 33, FIG. 4.

When a spool 33 containing a roll 3 of tape T is to be mounted in operative position in the housing 2, the cover 5 is first lifted off from the body portion 4, and the spool 33 is moved axially onto the hub 21 in position wherein the leading edge of the tape T on the roll 3 faces toward the cutter bar 15. In normal, unexpanded, at-rest position of the spool 33, the inner edges 42 of the teeth 36–39 are disposed on the circumference of a circle, the diameter of which is less than the outer diameter of the hub 21 by an amount equal to a minor fraction, such as, for example, one-eighth, of the distance that each of the teeth 36–39 projects inwardly from the inner periphery 35 of the spool 33 along the tailing edge 41 thereof. Preferably, the angle at which each of the leading edges 40 is disposed to the trailing edges 41 of the respective teeth 36–39 is such that when the spool 33 is disposed in operative position on the hub 21, with one of the teeth 36–39 projecting into the slot 22, in the manner illustrated with respect to the tooth 39 in FIG. 2, when the leading edge 40 of the tooth projecting into the slot 22 is disposed in engagement with the hub 21, the inner edges 42 of the other teeth, such as the teeth 36–38, are disposed in freely slidable, frictional engagement with the outer periphery of the hub 21, With this construction, when it is desired to mount the hub 33 on the spool 21, this may be readily accomplished by aligning one of the teeth 36–39 with the slot 22, in the manner illustrated with respect to the tooth 39 in FIG. 2, and then moving the spool 31 axially onto the hub 21, the inner edges 42 of the teeth 36–38 sliding inwardly along the outer periphery of the hub 21 while the tooth 39 slides inwardly through the slot 22. Thereafter, the cover 5 may be mounted in operative position on the body portion 4, as previously described, to thereby afford an assembled dispenser 1.

The spool 33 may be made of any suitable material, such as, for example, the aforementioned high impact polystyrene, and the body portion 43 is of such thickness, such as, for example, one-tenth of an inch, that during rotation of the spool 33 in a clockwise direction, around the hub 21, in an unwinding operation with respect to the tape T on the roll 3, as will be discussed in greater detail presently, the teeth 36–39 may sequentially ride into and out of the slot 22, the body portion 43 of the spool 33 contracting inwardly and expanding outwardly to permit this movement of the teeth 36–39 into and out of the slot 22. The leading edges 40 of the teeth 36–39 are at a forwardly projecting angle effective to cam the body portion 43 of the spindle 33 outwardly, by reason of the engagement of the leading edge 40 with the edge 44 of the hub 21, FIG. 2, during such rotation of the spool 33. Also, with the trailing edges 41 of the teeth 36–39 disposed in the aforementioned position, wherein they are disposed on respective radii of the spool 33, as the teeth 36–39 move along the outer periphery of the hub 21 into position wherein they enter the slot 22 in the latter, they so enter the slot 22 relatively abruptly, as the trailing edges 41 move past the edge 45 of the hub 21. As a result, as each of the teeth 36–39 enters the slot 22, when the spool 33 is being rotated by tension applied to the tape T on the roll 3, a perceptible jerk may be felt on the tape T, and, also, an audible click or snap may be heard. Also, with this construction, engagement of the trailing edges 41 with the edge 45 of the hub 21 is effective to prevent reverse rotation of the spool 33 around the hub 21.

Thus, in the operation of the novel dispenser 1, after it has been assembled in the aforementioned manner, with a roll of tape, such as the roll 3 of tape T disposed in operative position therein, the free end of the tape T may be manually pulled outwardly from the roll 3 into engagement with the upper face and outer edge of the head portion 16 of the cutter bar 15 and severed on the outer edge of the head portion 16 in the usual manner. Such pulling, of course, causes the roll 3 and the spindle 33 to rotate in a clockwise direction, as viewed in FIG. 2, to thereby cause the teeth 36–39 to move into and out of the slot 22 as they move therepast. Each time that one of the teeth 36–39 so moves into the slot 22, it affords a perceptible, but yieldable or releasable resistance to further rotation of the roll 3 and the spool 33. As a result, if the tape T is severed on the cutter bar 15 at this time, the portion of the tape T resting on top of the cutter bar 15 is pulled downwardly into engagement therewith with a force which is greater than the force that would be applied thereto if the roll 3 and spindle 33 were free to rotate on the hub 22, without resistance. This tends to seat the tape 2 more firmly on the cutter bar 15, so that it more firmly adheres thereto, which reduces the risk that the free end of the tape T will be accidentally displaced from the cutter bar 15 and permitted to fall down into adhering relation to the outer surface of the roll 3.

Thus, in the operation of the novel dispenser 1, as the teeth 36–39 move into the slot 22, increased resistance to the rotation of the roll 3 and the spool 33, which may be felt by the person unwinding the tape T from the roll 3 is afforded, and an audible click or snap is emmitted by the device 1, so that the person is advised both by the increased tension of the tape T and audibly that a tooth 36–39 has moved into position wherein it has moved into the slot 22. This affords an indication to the operator that a length of tape has been removed from the roll 3 which very closely corresponds to the length of tape that was previously removed therefrom during the rotation of the next adjacent tooth into the slot 22, and which length is very close to being the same as the length of tape that will be removed from the roll 3 by continued rotation of the roll 3 into position to dispose the next adjacent tooth 36–39 in the slot 22. Therefore, although the dispenser 1 does not precisely measure predetermined lengths of tape T by the movement of the teeth 36–39 into the slot 22, during removel of the tape T from the roll 3, because of the ever-diminishing diameter of the roll 3 as the tape T is removed therefrom, it does afford quite accurate measurement of substantially equal lengths of tape during each adjacent increment of rotation of the roll 3 and the spool 33; and it does cause the tape T to be more firmly adhered to the cutter bar 15 during severing of the tape T thereon, so as to protect against accidental dislodgement of the tape T from the cutter bar 15.

Although the spool 33 is shown in the drawings with four teeth 36–39 thereon, it will be appreciated by those skilled in the art that this is merely by way of illustration, and not by way of limitation, and that a greater or lesser number of teeth may be provided without departing from the purview of the broader aspects of the present invention.

Also, although the detents 36–39 are shown in the form of teeth embodying trailing edges 41 disposed on radii of the hub 33 and leading edges 40 disposed at acute angles to respective ones of the trailing edges 41, it will be appreciated by those skilled in the art that this is merely by way of illustration of the preferred form of the present invention and not by way of limitation, and both edges 40 and 41 may be of different form, such as, for example, both being disposed at an acute angle to radii of the hub 33, or both being of a covex-outwardly, rounded form, or the like, without departing from the purview of the broader aspects of the present invention.

Figure 6:
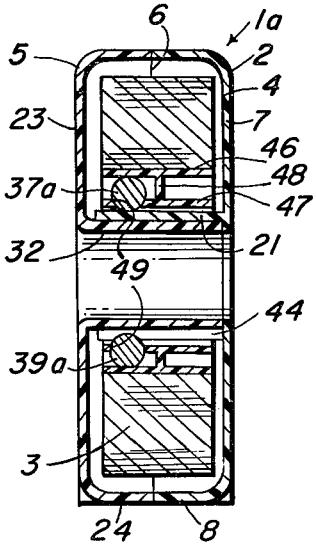
FIG. 6 is a detail sectional view, similar to FIG. 4, but taken substantially along the line 6–6 in FIG. 5.
Figure 5:
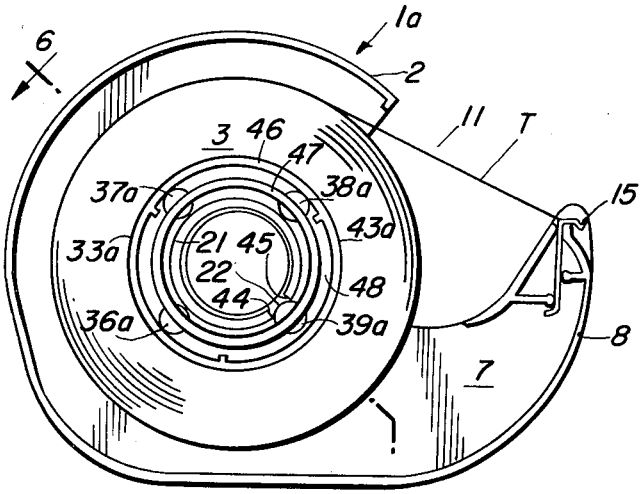
FIG. 5 is a view similar to FIG. 2, but showing a modified form of the invention.

A modified form of the present invention is illustrated in FIGS. 5 and 6 of the drawings. The modified form shown in FIGS. 5 and 6 embodies the same basic principles as the preferred form of the invention shown in FIGS. 1–4, inclusive, and parts which are the same as parts shown in FIGS. 1–4 are indicated by the same reference numerals, and parts which are similar to parts shown in FIGS. 1–4, but have been substituted therefor, are indicated by the same reference numerals with the suffix "a" added thereto.

The dispenser **1*a* shown in FIGS. 5 and 6 embodies a housing 2 which is identical to the housing 2 shown in FIGS. 1–4. However, the spool 33*a* on which the roll 3 of tape T is mounted is somewhat different than the spool 33 shown in FIGS. 1–4**.

The body portion **43*a* of the spool 33*a* embodies two concentric annular members 46 and 47 disposed on respective opposite sides of a sidewall 48. The spool 33** may be made of any suitable material, such as, for example, the aforementioned polystyrene and is preferably of one-piece construction, with the annular member 46, like the body portion 43, shown in FIGS. 1–4, being relatively thin and flexible.

In the dispenser 1*a*, shown in FIGS. 5 and 6, instead of the spool 33*a* having teeth, such as the teeth 36–39, shown in FIGS. 1–4, four balls 36*a*, 37*a*, 38*a* and 39*a* are disposed in the spool 33*a* between the annular members 46 and 47. Each of the balls 36*a*–39*a* is disposed in a respective opening 49 extending radially through the inner annular member 47, FIG. 6, the openings 49 being of such diameter that the balls 36*a*–39*a* may extend through the annular member 47, but may not pass completely therethrough.

With this construction, during rotation of the spool 33*a* around the hub 21, in a tape dispensing operation, the balls 36*a*—39*a* roll around the outer periphery of the hub 21, and are held in firm frictional engagement therewith by the outer annular member 46. The balls 36*a*–39*a* are of such size that, when they pass into radial alignment with the slot 22 in the hub 21, they move downwardly thereinto, to act as a detent which yieldingly or releasably restrains further rotation of the spool 33*a* in a manner similar to that in which the teeth 36–39 operate in the preferred form of the invention shown in FIGS. 1–4. The balls 36*a*–39*a* may be made of any suitable material, such as, for example, the aforementioned high impact polystyrene.

In the operation of the dispenser 1, after one of the balls 36*a*–39*a* has moved into the slot 22, as illustrated by the ball 39*a* in FIG. 5, during continued rotation of the spool 33*a*, the balls 39*a* is cammed outwardly by the edge 44 of the hub 21, the outer annular member 46 yieldingly moving outwardly to thereby permit such outward movement of the ball.

In mounting the spool 33*a* on the hub 21, one of the balls, preferably, is aligned with the slot 22, in the manner illustrated with respect to the ball 39*a* in FIG. 5, and the spool 39*a* is then moved longitudinally onto the hub 21. However, if desired, the spool 33*a* may be moved onto the hub 21 without the aforementioned initial alignment of one of the balls 36*a*–39*a* with the slot 22, the rounded surfaces of the balls 36*a*–39*a*, projecting inwardly through the inner annular member 47, affording lead-in cam surfaces so that the spool 33*a* may be readily mounted onto the hub 22 even though none of the balls 36*a*–39*a* are so aligned with the slot 22.

The dispenser 1*a* operates in the same manner as the dispenser 1, the engagement of the balls or detents 36*a*–39*a* in the slot 22 affording a resistance, which can be felt, to further removal of the tape T from the roll 3, and affording an audible click or snap as the ball moves into the slot 22, as well as affording a resistance to rotation of the roll 3 and spool 33*a* which is effective to assist in firmly adhesively securing the tape T to the cutter bar 15.

Figure 8:
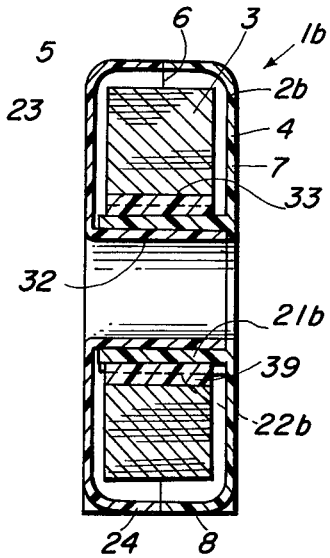
FIG. 8 is a view similar to FIG. 4, but taken substantially along the line 8–8 in FIG. 7.
Figure 7:
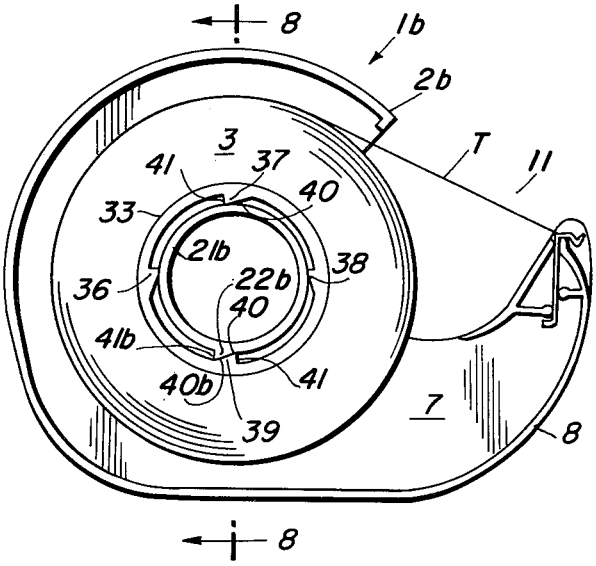
FIG. 7 is a view similar to FIG. 2, but showing another modified form of the present invention.

Another modified form of the present invention is illustrated in FIGS. 7 and 8 of the drawings. This modified form of the invention also embodies the same general principles as the preferred form illustrated in FIGS. 1–4, inclusive, and parts which are the same as parts shown in FIGS. 1–4 are indicated by the same reference numerals, and parts which are similar but which have been substituted for parts shown in FIGS. 1–4 are indicated by the same reference numerals with the suffix "b" added.

In the dispenser 1*b* shown in FIGS. 7 and 8, the spool 33 and the roll 3 are identical in construction to the spool and roll shown in FIGS. 1–4 and the housing 2*a* is the same as the housing 2, shown in FIGS. 1–4, except that the slot 22 has been eliminated from the hub 21*b* and a detent in the form of a tooth 22*b*, projecting outwardly from the hub 21 into the path of travel of the teeth 36–39, has been substituted therefor. The tooth 22*b* has a rear edge 40*b*, which is similar to the leading edges 40 of the teeth 36–39, and is disposed in position to engage the leading edges 40 of the teeth 36–39 during rotation of the spool 33 around the hub 21*b*. The tooth 22*b*, also has a front edge 41*b*, facing in the direction of rotation of the spool 33 around the hub 21*b*. Like the trailing edges 41 of the teeth 36–39, the front face 41*b* of the tooth 22*b* preferably is disposed on a radius of the hub 21*b*. With this construction, engagement of the trailing edges 41 with the front edge 41*b* is effective to prevent reverse rotation of the spool 33 around the hub 21*b*.

In the operation of the dispenser 1*b*, as tape T is unwound from the roll 3, and the spindle 33 rotates in a clockwise direction, as viewed in FIG. 7, around the hub 21*b*, the leading edges 40 of the teeth 36–39 sequentially engage the rear edge 40*b* of the tooth 22*b* to thereby yieldingly or releasably resist further rotation of the spool 33 around the hub 21*b*. Continued tension on the tape T causes the leading edge 40 of the tooth 36, 37, 38 or 39 engaged with the rear edge 40*b* of the tooth 22*b* to ride outwardly along the latter and thus move past the tooth 22*b*, the body portion 43 of the spool 33 yieldingly moving outwardly to accommodate this outward movement of the tooth 36, 37, 38 or 39.

Thus, like the dispensers 1 and 1*a*, the dispenser 1*b* is effective to afford a releasable resistance, which may be felt, to the withdrawal of the tape T from the roll 3 and to afford an audible snap or click, as the teeth 36–39 sequentially engage and pass over the tooth 22*b*. In addition, the resistance to rotation of the spool 33 by the engagement of the teeth 36–39 wiht the tooth 22*b* is effective to cause the tape T to be firmly adhered to the cutter bar 15 when the tape T is severed on the cutter bar 15 with one of the teeth 36–39 disposed in abutting engagement with the tooth 22*b*.

From the foregoing, it will be seen that the present invention affords a novel dispenser.

Also, it will be seen that the present invention affords a novel disperser for rolls of flexible material.

In addition, it will be seen that the present invention affords a novel dispenser, which is particularly well adapted for dispensing pressure sensitive tape from a roll thereof.

Also, it will be seen that the present invention affords a novel dispenser of the aforementioned type which is practical and efficient in operation and which may be readily and economically produced commercially.

Thus, while I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A dispenser comprising a. a housing having an outlet opening therein b. a spool, c. a spirally wound roll of flexible material mounted on said spool for rotation therewith
(1) in one direction effective to unwind said flexible material from said roll, and
(2) in another direction effective to wind said flexible material onto said roll,
d. a hub mounted in said housing for rotatably supporting said spool,
e. said spool being mounted on said hub for rotation therearound in said one direction,
f. said hub being disposed in such position in said housing that said unwinding of said flexible material from said roll by pulling on said flexible material is effective to rotate said spool around said hub in said one direction,
g. said spool having a plurality of inwardly projecting detents disposed in spaced relation to each other therearound, and
h. said hub having a detent disposed in position thereon to so sequentially engage each of said plurality of detents during a complete rotation of said spool around said hub in said one direction as to resist but permit further rotation of said spool around said hub in said one direction.

2. A dispenser as defined in claim 1, and in which
a. said detent on said hub comprises a member projecting toward said spool.

3. A dispenser as defined in claim 1, and in which
a. said detent on said hub comprises a recess in the outer periphery thereof.

4. A dispenser as defined in claim 1, and in which
a. said detent on said hub comprises a slot extending therethrough in substantially parallel relation to the axis of rotation of said spool around said hub.

5. In a dispenser for pressure sensitive tape embodying a housing for a roll of such tape, and a cutter bar for severing an end portion of such tape from the remainder thereof and adhesively holding the free end portion of said remainder after said end portion has been so severed, the combination of
a. a hub disposed in said housing,
b. a spool mounted on said hub for rotation therearound,
c. a roll of pressure sensitive tape mounted on said spool for rotation therewith,
d. said tape being disposed in a spiral around said spool in such position that tension applied to the outer free end of said tape toward said cutter bar will cause said roll and spool to rotate around said hub in a direction to unwind said tape from said roll toward said cutter bar,
e. said hub having a detent on the outer periphery thereof,
f. said spool having a plurality of detents on the inner periphery thereof,
g. said detent on said hub being disposed in position to retardingly, but releasably, sequentially engage each detent of said plurality of detents during said tape-unwinding rotation of said roll and spool.

6. The combination defined in claim 5, and in which
a. said first mentioned detent comprises a member projecting outwardly from said hub, and
b. said plurality of detents comprise members projecting inwardly from said spool.

7. The combination defined in claim 5, and in which
a. said first mentioned detent comprises a recess in the outer periphery of said hub.

8. The combination defined in claim 7, and in which
a. said plurality of detents comprise members fixedly attached to said spool.

9. The combination defined in claim 7, and in which
a. said plurality of detents comprise balls rotatably mounted in said spool.

10. The combination defined in claim 9, and in which
a. said spool includes means engaging respective ones of said balls for preventing said balls from moving around the inner periphery of said spool during said rotation of said spool around said hub.

11. The combination defined in claim 10, and in which
a. said means engaging respective ones of said balls comprises side wall portions defining respective openings in said spool.

12. The combination defined in claim 11, and in which
a. said spool includes
(1) an inner annular member rotatably mounted on said hub, and
(2) an outer annular member disposed outwardly of said inner annular member in substantially concentric relation thereto,
b. said openings comprise holes extending through said inner annular member in spaced relation to each other, and
c. said balls are disposed between said inner and outer annular members.

* * * * *